US011823522B2

(12) United States Patent
Rauscher et al.

(10) Patent No.: US 11,823,522 B2
(45) Date of Patent: Nov. 21, 2023

(54) COMPLETENESS CHECK OF A VALUE DOCUMENT

(71) Applicant: GIESECKE+DEVRIENT CURRENCY TECHNOLOGY GMBH, Munich (DE)

(72) Inventors: Wolfgang Rauscher, Parkstetten (DE); Erich Kerst, Unterföhring (DE); Thomas Happ, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 721 days.

(21) Appl. No.: 16/068,022

(22) PCT Filed: Dec. 21, 2016

(86) PCT No.: PCT/EP2016/002156
§ 371 (c)(1),
(2) Date: Jul. 3, 2018

(87) PCT Pub. No.: WO2017/118467
PCT Pub. Date: Jul. 13, 2017

(65) Prior Publication Data

US 2020/0273279 A1 Aug. 27, 2020

(30) Foreign Application Priority Data

Jan. 5, 2016 (DE) ..... 10 2016 000 011.2

(51) Int. Cl.
*G07D 7/20* (2016.01)
*G07D 7/1205* (2016.01)
(Continued)

(52) U.S. Cl.
CPC ..... *G07D 7/2016* (2013.01); *G07D 7/1205* (2017.05); *G07D 7/162* (2013.01);
(Continued)

(58) Field of Classification Search
CPC .... B42D 25/29; B42D 25/328; B42D 25/373; G07D 7/12; G07D 7/1205; G07D 7/162;
(Continued)

(56) References Cited

U.S. PATENT DOCUMENTS 6,393,140 B1 5/2002 Tako
7,829,869 B2 11/2010 Schützmann et al.
(Continued)

FOREIGN PATENT DOCUMENTS

DE 19714519 A1 8/1998
DE 10346636 A1 5/2005
(Continued)

OTHER PUBLICATIONS

International Search Report from PCT Application No. PCT/EP2016/002156, dated Apr. 4, 2017.

*Primary Examiner* — Violeta A Prieto
(74) *Attorney, Agent, or Firm* — WORKMAN NYDEGGER

(57) ABSTRACT

The present invention relates to a method, a sensor, a sensor unit and a bank-note processing machine for checking the completeness and/or authenticity of value documents. A value document comprises at least one machine-readable feature substance in at the least two locations. According to the method, the value document is excited at least locally at measuring locations. Furthermore, a feature intensity with respect to the machine-readable feature substance is captured location-resolved at several different locations of the value document. The location-based feature intensities are classified location-based with the help of a threshold value. Furthermore, location-based limits of a location distribution to be expected of the machine-readable feature substance are determined. Finally, a location-based distribution of the classified feature intensities is assessed.

18 Claims, 13 Drawing Sheets

(51) Int. Cl.

| | |
|---|---|
| ***G07D 7/202*** | (2016.01) |
| ***G07D 7/162*** | (2016.01) |
| *B42D 25/29* | (2014.01) |
| *B42D 25/328* | (2014.01) |
| *B42D 25/373* | (2014.01) |

(52) U.S. Cl.
CPC ..... *G07D 7/205* (2013.01); *B42D 25/29* (2014.10); *B42D 25/328* (2014.10); *B42D 25/373* (2014.10); *G07D 2207/00* (2013.01)

(58) Field of Classification Search
CPC ... G07D 7/2016; G07D 7/205; G07D 2207/00
See application file for complete search history.

(56) References Cited

U.S. PATENT DOCUMENTS

| | | | | |
|---|---|---|---|---|
| 8,047,447 | B2 * | 11/2011 | Bulan | G06K 7/00 235/487 |
| 8,100,330 | B2 * | 1/2012 | Bulan | G06K 7/10 235/462.04 |
| 8,837,804 | B2 | 9/2014 | Su et al. | |
| 8,917,386 | B2 | 12/2014 | Holl et al. | |
| 9,031,307 | B2 | 5/2015 | Giering | |
| 9,672,510 | B2 * | 6/2017 | Roach | G06K 9/00442 |
| 10,628,647 | B1 * | 4/2020 | Rossier | B42D 25/305 |
| 10,936,866 | B2 * | 3/2021 | Berger | G07D 7/2016 |
| 11,017,478 | B2 * | 5/2021 | Strange | G06V 30/1475 |
| 11,068,681 | B2 * | 7/2021 | Frieser | G07D 7/12 |
| 11,351,810 | B2 * | 6/2022 | Walger | B42D 25/342 |
| 11,539,848 | B2 * | 12/2022 | Roach | G06Q 20/387 |
| 2005/0100204 | A1 | 5/2005 | Afzal et al. | |
| 2007/0189595 | A1 | 8/2007 | Giering | |
| 2009/0078886 | A1 | 3/2009 | Schutzmann et al. | |
| 2010/0128934 | A1 | 5/2010 | Su et al. | |
| 2010/0157377 | A1 * | 6/2010 | Zhao | B42D 25/333 358/3.28 |
| 2013/0088712 | A1 | 4/2013 | Holl et al. | |
| 2017/0070633 | A1 * | 3/2017 | Kure | H04N 1/00737 |
| 2017/0270508 | A1 * | 9/2017 | Roach | G06K 9/3275 |
| 2019/0054734 | A1 * | 2/2019 | Baran | B41F 33/16 |
| 2019/0066224 | A1 * | 2/2019 | Strange | G06V 10/243 |
| 2019/0384955 | A1 * | 12/2019 | Frieser | G07D 7/1205 |
| 2020/0110932 | A1 * | 4/2020 | Berger | G07D 7/206 |
| 2020/0304650 | A1 * | 9/2020 | Roach | G06Q 20/387 |
| 2021/0019976 | A1 * | 1/2021 | Kerst | G07F 7/10 |
| 2021/0304318 | A1 * | 9/2021 | Strange | G06V 10/243 |
| 2021/0370666 | A1 * | 12/2021 | Baran | B42D 25/387 |
| 2022/0072892 | A1 * | 3/2022 | Walger | G07D 7/20 |

FOREIGN PATENT DOCUMENTS

| | | | |
|---|---|---|---|
| DE | 102007019107 | A1 | 10/2008 |
| DE | 102007044878 | A1 | 4/2009 |
| DE | 102010021803 | A1 | 12/2011 |
| WO | 2011037750 | A2 | 3/2011 |

* cited by examiner

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 28 | 64 | 63 | 63 | 62 | 63 | 63 | 65 | 66 | 61 | 62 | 61 | 61 | 58 | 52 | 52 | 51 | 51 | 51 | 54 | 59 | 64 | 103 | 106 | 90 | 62 | 65 | 2 | 0 | 0 |
| 0 | 25 | 55 | 55 | 54 | 54 | 55 | 55 | 65 | 73 | 73 | 76 | 75 | 74 | 66 | 50 | 58 | 55 | 49 | 46 | 42 | 47 | 57 | 97 | 92 | 73 | 51 | 54 | 2 | 0 | 0 |
| 0 | 25 | 56 | 55 | 48 | 48 | 40 | 48 | 65 | 74 | 74 | 75 | 75 | 74 | 66 | 50 | 60 | 61 | 59 | 60 | 54 | 55 | 66 | 97 | 86 | 87 | 59 | 65 | 2 | 0 | 0 |
| 0 | 30 | 68 | 34 | 4 | 4 | 4 | 4 | 39 | 73 | 74 | 76 | 75 | 75 | 72 | 51 | 58 | 57 | 61 | 58 | 53 | 58 | 68 | 99 | 95 | 88 | 74 | 70 | 2 | 0 | 0 |
| 0 | 32 | 75 | 13 | 2 | 3 | 2 | 16 | 75 | 75 | 74 | 75 | 73 | 75 | 73 | 60 | 56 | 47 | 60 | 47 | 44 | 53 | 70 | 97 | 101 | 85 | 76 | 78 | 2 | 0 | 0 |
| 0 | 33 | 76 | 58 | 15 | 6 | 15 | 59 | 75 | 72 | 73 | 75 | 70 | 69 | 73 | 71 | 60 | 59 | 56 | 53 | 57 | 59 | 75 | 97 | 88 | 84 | 74 | 78 | 2 | 0 | 0 |
| 0 | 33 | 76 | 76 | 76 | 76 | 76 | 76 | 76 | 74 | 73 | 76 | 73 | 70 | 73 | 74 | 62 | 57 | 55 | 51 | 57 | 66 | 76 | 102 | 92 | 95 | 70 | 78 | 2 | 0 | 0 |
| 0 | 33 | 76 | 76 | 76 | 76 | 76 | 76 | 75 | 75 | 74 | 73 | 73 | 72 | 71 | 74 | 70 | 56 | 55 | 47 | 56 | 69 | 76 | 106 | 99 | 95 | 70 | 75 | 2 | 0 | 0 |
| 0 | 33 | 76 | 76 | 76 | 76 | 76 | 69 | 66 | 65 | 65 | 67 | 65 | 54 | 60 | 61 | 60 | 53 | 60 | 55 | 54 | 66 | 75 | 101 | 91 | 92 | 71 | 75 | 2 | 0 | 0 |
| 0 | 31 | 71 | 68 | 67 | 66 | 69 | 65 | 64 | 62 | 62 | 65 | 64 | 54 | 54 | 55 | 47 | 45 | 47 | 43 | 45 | 54 | 63 | 99 | 89 | 90 | 58 | 66 | 2 | 0 | 0 |
| 0 | 20 | 45 | 45 | 46 | 45 | 48 | 46 | 45 | 42 | 42 | 42 | 43 | 41 | 41 | 39 | 41 | 41 | 41 | 41 | 43 | 45 | 47 | 74 | 75 | 66 | 44 | 48 | 1 | 0 | 0 |

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 36 | 81 | 79 | 78 | 79 | 80 | 82 | 83 | 77 | 78 | 78 | 77 | 73 | 66 | 65 | 64 | 64 | 64 | 64 | 68 | 74 | 81 | 30 | 21 | 40 | 79 | 82 | 3 | 0 | 0 |
| 0 | 31 | 70 | 70 | 69 | 70 | 70 | 83 | 92 | 92 | 96 | 96 | 94 | 84 | 83 | 73 | 69 | 66 | 62 | 58 | 53 | 59 | 72 | 28 | 16 | 33 | 65 | 68 | 2 | 0 | 0 |
| 0 | 31 | 71 | 70 | 60 | 50 | 61 | 83 | 93 | 94 | 95 | 94 | 94 | 83 | 83 | 75 | 77 | 78 | 74 | 78 | 68 | 69 | 84 | 29 | 14 | 42 | 75 | 70 | 2 | 0 | 0 |
| 0 | 38 | 86 | 42 | 0 | 0 | 0 | 49 | 92 | 94 | 96 | 95 | 94 | 90 | 85 | 73 | 72 | 79 | 78 | 74 | 68 | 73 | 85 | 29 | 17 | 44 | 94 | 88 | 3 | 0 | 0 |
| 0 | 41 | 95 | 17 | 0 | 0 | 0 | 20 | 94 | 93 | 94 | 94 | 92 | 93 | 76 | 70 | 76 | 84 | 76 | 60 | 58 | 67 | 89 | 29 | 20 | 43 | 96 | 96 | 3 | 0 | 0 |
| 0 | 42 | 96 | 73 | 18 | 4 | 20 | 75 | 95 | 91 | 94 | 88 | 87 | 92 | 90 | 76 | 75 | 74 | 71 | 68 | 72 | 75 | 94 | 29 | 15 | 43 | 93 | 96 | 3 | 0 | 0 |
| 0 | 42 | 96 | 96 | 96 | 96 | 96 | 96 | 93 | 92 | 96 | 92 | 89 | 92 | 94 | 79 | 72 | 72 | 70 | 64 | 72 | 83 | 96 | 31 | 17 | 47 | 88 | 95 | 3 | 0 | 0 |
| 0 | 42 | 96 | 96 | 96 | 96 | 96 | 96 | 94 | 93 | 92 | 93 | 90 | 89 | 93 | 88 | 71 | 67 | 69 | 60 | 71 | 87 | 96 | 32 | 19 | 46 | 88 | 95 | 3 | 0 | 0 |
| 0 | 42 | 96 | 96 | 96 | 96 | 96 | 87 | 83 | 82 | 84 | 82 | 68 | 76 | 77 | 75 | 68 | 76 | 69 | 69 | 68 | 84 | 95 | 30 | 16 | 45 | 90 | 95 | 3 | 0 | 0 |
| 0 | 39 | 90 | 86 | 85 | 84 | 87 | 82 | 81 | 79 | 82 | 81 | 68 | 68 | 69 | 60 | 57 | 60 | 61 | 55 | 56 | 68 | 79 | 29 | 16 | 44 | 73 | 83 | 3 | 0 | 0 |
| 0 | 25 | 57 | 57 | 59 | 57 | 58 | 58 | 57 | 54 | 53 | 55 | 51 | 52 | 50 | 52 | 51 | 51 | 51 | 52 | 56 | 57 | 59 | 21 | 16 | 31 | 56 | 58 | 2 | 0 | 0 |

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 35 | 80 | 78 | 78 | 79 | 81 | 82 | 76 | 77 | 77 | 76 | 72 | 65 | 64 | 64 | 63 | 63 | 63 | 68 | 73 | 80 | 17 | 8 | 31 | 78 | 81 | 3 | 0 | 0 |
| 0 | 31 | 69 | 69 | 68 | 69 | 69 | 82 | 92 | 91 | 95 | 94 | 93 | 63 | 72 | 69 | 65 | 62 | 67 | 53 | 59 | 71 | 17 | 6 | 26 | 64 | 67 | 2 | 0 | 0 |
| 0 | 31 | 70 | 68 | 60 | 50 | 60 | 82 | 92 | 93 | 94 | 93 | 93 | 63 | 75 | 78 | 77 | 73 | 75 | 68 | 69 | 83 | 18 | 5 | 34 | 66 | 50 | 1 | 0 | 0 |
| 0 | 38 | 86 | 42 | 0 | 0 | 0 | 48 | 91 | 93 | 95 | 94 | 93 | 64 | 73 | 72 | 78 | 77 | 73 | 63 | 55 | 49 | 8 | 1 | 1 | 0 | 0 | 0 | 0 | 0 |
| 0 | 41 | 94 | 17 | 0 | 0 | 0 | 19 | 93 | 93 | 93 | 91 | 93 | 92 | 72 | 54 | 36 | 28 | 22 | 7 | 0 | 0 | 0 | 0 | 2 | 17 | 33 | 1 | 0 | 0 |
| 0 | 42 | 95 | 72 | 18 | 4 | 19 | 74 | 92 | 76 | 63 | 46 | 30 | 14 | 1 | 0 | 0 | 0 | 0 | 1 | 11 | 24 | 46 | 11 | 4 | 36 | 95 | 3 | 0 | 0 |
| 0 | 42 | 95 | 83 | 67 | 51 | 34 | 18 | 3 | 0 | 0 | 0 | 0 | 0 | 10 | 22 | 31 | 45 | 55 | 61 | 71 | 82 | 95 | 18 | 6 | 37 | 94 | 3 | 0 | 0 |
| 0 | 7 | 5 | 0 | 0 | 0 | 0 | 0 | 6 | 23 | 38 | 53 | 67 | 83 | 92 | 87 | 70 | 67 | 68 | 59 | 71 | 86 | 95 | 19 | 7 | 37 | 94 | 3 | 0 | 0 |
| 0 | 0 | 4 | 19 | 36 | 52 | 69 | 77 | 82 | 81 | 83 | 81 | 67 | 75 | 76 | 75 | 67 | 75 | 69 | 68 | 68 | 83 | 94 | 18 | 6 | 37 | 89 | 94 | 3 | 0 | 0 |
| 0 | 34 | 88 | 85 | 84 | 83 | 86 | 81 | 80 | 78 | 81 | 80 | 58 | 68 | 68 | 59 | 56 | 59 | 60 | 54 | 56 | 67 | 79 | 18 | 5 | 35 | 73 | 82 | 3 | 0 | 0 |
| 0 | 25 | 56 | 57 | 58 | 56 | 57 | 57 | 56 | 53 | 52 | 54 | 50 | 52 | 49 | 51 | 51 | 51 | 51 | 52 | 54 | 57 | 59 | 12 | 5 | 24 | 55 | 58 | 1 | 0 | 0 |

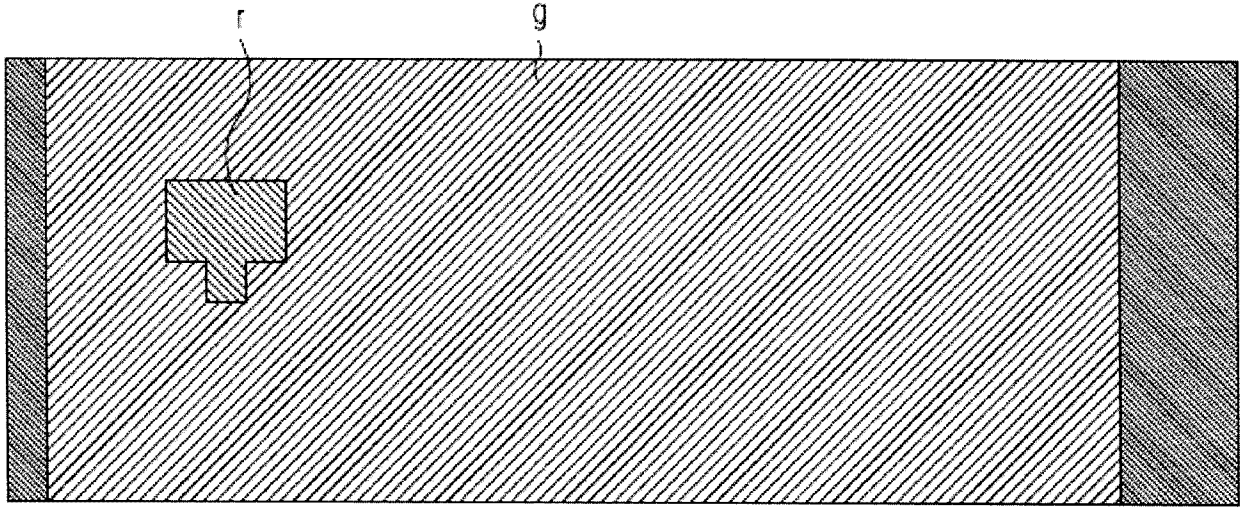
| | | | | | | | | | | | |
|---|---|---|---|---|---|---|---|---|---|---|---|
| 9 | 9 | 9 | 9 | 9 | 9 | 9 | 9 | 9 | 9 | 9 | 9 |
| 9 | 9 | 9 | 9 | 9 | 9 | 9 | 9 | 9 | 9 | 9 | 9 |
| 9 | 9 | 9 | 9 | 9 | 9 | 9 | 9 | 9 | 9 | 9 | 9 |
| 3 | 3 | 3 | 3 | 3 | 3 | 3 | 3 | 3 | 3 | 3 | 3

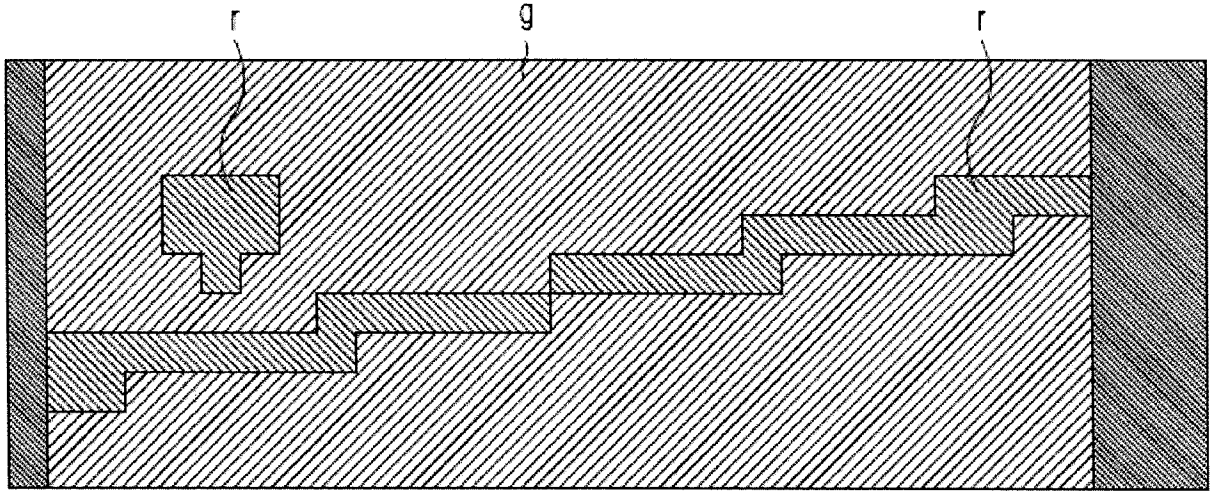
| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 0 |

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 90 | 59 | 18 | 18 | 18 | 18 | 18 | 19 | 17 | 18 | 18 | 17 | 16 | 15 | 15 | 14 | 14 | 15 | 17 | 18 | 2 | 0 | 6 | 18 | 18 | 88 | 90 | 92 |
| 90 | 58 | 16 | 16 | 16 | 16 | 16 | 19 | 21 | 22 | 21 | 21 | 19 | 16 | 16 | 15 | 14 | 12 | 13 | 16 | 2 | 0 | 5 | 15 | 15 | 88 | 90 | 92 |
| 90 | 58 | 16 | 16 | 26 | 37 | 25 | 19 | 21 | 21 | 21 | 21 | 19 | 17 | 17 | 18 | 17 | 15 | 16 | 19 | 3 | 0 | 7 | 17 | 16 | 88 | 90 | 92 |
| 90 | 59 | 20 | 53 | 90 | 90 | 90 | 52 | 21 | 21 | 22 | 21 | 20 | 18 | 18 | 18 | 17 | 15 | 17 | 19 | 3 | 0 | 7 | 21 | 20 | 88 | 90 | 92 |
| 90 | 60 | 21 | 78 | 90 | 90 | 90 | 76 | 21 | 21 | 21 | 21 | 21 | 16 | 13 | 14 | 17 | 13 | 15 | 20 | 3 | 0 | 7 | 22 | 22 | 88 | 90 | 92 |
| 90 | 60 | 22 | 38 | 77 | 88 | 76 | 37 | 21 | 21 | 21 | 20 | 21 | 17 | 17 | 17 | 16 | 15 | 17 | 21 | 3 | 0 | 7 | 21 | 22 | 88 | 90 | 92 |
| 90 | 60 | 22 | 22 | 22 | 22 | 22 | 21 | 21 | 22 | 21 | 20 | 21 | 18 | 16 | 18 | 16 | 14 | 19 | 22 | 3 | 0 | 7 | 20 | 22 | 88 | 90 | 92 |
| 90 | 60 | 22 | 22 | 22 | 22 | 22 | 21 | 21 | 21 | 21 | 20 | 20 | 20 | 15 | 18 | 16 | 13 | 20 | 22 | 3 | 0 | 7 | 20 | 22 | 88 | 90 | 92 |
| 90 | 60 | 22 | 22 | 22 | 22 | 20 | 15 | 15 | 15 | 19 | 15 | 17 | 15 | 17 | 17 | 15 | 16 | 19 | 21 | 3 | 0 | 7 | 20 | 21 | 88 | 90 | 92 |
| 93 | 59 | 20 | 19 | 19 | 20 | 18 | 18 | 18 | 18 | 18 | 15 | 15 | 14 | 13 | 13 | 12 | 13 | 15 | 18 | 3 | 0 | 7 | 17 | 19 | 88 | 90 | 92 |
| 92 | 68 | 38 | 39 | 39 | 39 | 39 | 38 | 38 | 38 | 38 | 37 | 37 | 37 | 37 | 37 | 38 | 39 | 39 | 39 | 27 | 26 | 30 | 38 | 39 | 90 | 92 | 93 |

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 4 | 4 | 3 | 3 | 3 | 3 | 3 | 3 |
| 3 | 3 | 3 | 3 | 4 | 4 | 4 | 3 | 3 | 3 | 3 | 3 |
| 3 | 3 | 3 | 3 | 4 | 4 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 |
| 0 | 3 | 3 | 3 | 3 | 3 | 3 | 3 | 3 | 3 | 3 | 3 |
| 0 | 3 | 3 | 3 | 3 | 3 | 3 | 3 | 3 | 3 | 3 | 3 |
| 0 | 3 | 3 | 3 | 3 | 3 | 3 | 3 | 3 | 3 | 3 | 3 |

| Classification 1 | Classification 2 | Classification combined |
|---|---|---|
| green | green | green |
| green | red | green |
| green | black | green |
| green | yellow | green |
| red | yellow | yellow |
| red | red | red |
| red | black | red |
| red | green | green |
| black | black | black |
| black | green | green |
| black | yellow | yellow |
| black | red | red |
| yellow | yellow | yellow |
| yellow | black | yellow |
| yellow | green | green |
| yellow | red | yellow |

Fig. 13

COMPLETENESS CHECK OF A VALUE DOCUMENT

BACKGROUND

The present invention relates to a method and a corresponding apparatus for checking value documents for completeness and authenticity. Forgeries of value documents could be composed of a multiplicity of partial documents for which, e.g. sections of authentic value documents were combined with portions of copies. According to the invention it is possible to identify such forgeries reliably and to check value documents for their completeness or authenticity.

DE 1971 4519 A1 teaches to scan a document to be checked over the full area or along a defined measuring track using a sensor suitable for the proof of the marker substance. In the process, the distribution of the marker signal is determined and compared with the expected signal course pre-specified by the pattern of the marking imprinted with the marker substance. In the process, it is in particular checked for the general presence of the feature substance, for steps in its distribution as well as for regions diverging from the expected reference distribution.

DE 10 346 636 A1 describes a sensor-based authenticity check of value documents with a luminescence marker which is effected integrally along a track straight across the value document. While the addition of the luminescence signal along the measuring track is well suited for detecting small, noisy spectral signals, it is precisely this that prevents a detailed and with it precise assessment of the completeness.

WO 2011/037750 A2 describes the authenticity detection of bank notes by way of the proof of a homogeneously distributed IR of luminescent substance along measuring tracks and matching of the measured modulation of the luminescence intensity by overprinting or applied holograms, strips etc. with expected target profiles. In the process, regions with high statistical fluctuation such as safety thread or hologram strip are excluded from the assessment and an authenticity decision is made if e.g. >51% of the measured profile match one of four position-dependent authenticity references.

With it, under ideal conditions a completeness statement is indeed possible also along the measured track. Upon a measurement on fast-running bank-note processing machines under real-world conditions with real track position variations or skew of the bank notes in the machine as well as aging or stains on the bank notes, many authentic bank notes are, however, classified as false by this method. Conversely, for the described, in order to avoid many wrongly classified bank notes as false necessarily weak authenticity criteria of e.g. only >51% agreement along a track, a large number of snippet forgeries are detected as authentic, so that this procedure does not solve the problem satisfactorily.

U.S. Pat. No. 6,393,140 B1 describes a further method for checking bank notes in which a signal, such as e.g. the color or magnetism at several defined places of the bank note, is measured and respectively the relative distances of the measurement values from a reference value are determined and thereupon normalized. With it, this method indeed enables a local authenticity assessment, but no reliable completeness check.

Primarily upon measurements on fast-running bank-note processing machines having processing speeds up to above 12 m/s, beyond a slow transport ticket check, however, additional challenges occur which have to be addressed by special methods and algorithms. Only then one succeeds even under such impeded conditions in making a reliably functioning completeness check possible. For example, is not always ensured for a bank-note processing machine that at the time of the evaluation also the denomination or position of the value document is known and with it the reference distribution to be compared.

Furthermore, the reachable locational resolution of the feature signal can be reduced dramatically in comparison to conventional resolutions of optical image sensors in the visible region: The locational resolution can be limited by the detector technology used, as well as by intrinsic time properties of the feature substance such as of the rise time of a luminescent substance. In particular for track-bound sensors, the pixel size can by all means lie in the region of some mm or even a few cm. To be able to derive in such situations the completeness of the value document from the feature measurement as reliably as possible, the information item of each individual measurement pixel has to be assessed adequately and be drawn upon for the completeness check.

SUMMARY

The present invention has the aim of making a reliable completeness measurement or completeness check of modern value documents possible for recognizing so-called snippet forgeries under the conditions of fast-running bank-note processing machines (i.e. measurement with relative speeds, for example of 1-13 m/s, preferably 6-12 m/s, between bank note and sensor). By the combination of divers security features on the value document and their interaction with the sensor-based measurement of the machine-readable feature, a complex modulation pattern of the measured intensity of the feature signal frequently occurs even for homogeneously present machine-readable feature substance. This impedes the direct completeness assessment considerably. In the process, in particular the case frequently present in reality is assumed that at the time of the measurement or the completeness assessment no denomination or position information item is present.

It is therefore an object of the present invention to supply a method or an apparatus which carries out a reliable assessment of the completeness of a document.

This object is achieved by a method or an apparatus for checking a completeness of value documents having the features of the independent claims. In the claims dependent thereon there are stated advantageous embodiments and developments of the invention.

Accordingly a method is proposed for checking a completeness and/or authenticity of value documents. According to the invention, at the least one value document comprises at least one machine-readable feature substance at two different locations at the least. In a step the value document is excited at least locally. This can be effected, for example, by means of electromagnetic radiation, for example light with a wavelength in the visible spectral region. In addition or alternatively, a magnetic subjecting of the value document can be effected.

Furthermore, according to the invention a feature intensity with respect to the machine-readable feature substance is captured at several different locations of the value document. For this purpose an optical and/or magnetic capture unit can be used. The capture unit correspondingly forms a feature value for each measuring location. From the feature value, the feature intensity will determined location-based as to the measuring locations of the value document. The locally limited areal element of the location-based feature intensity and/or the location-based remission value can hereinafter be understood as a pixel. In the process, a feature value or a plurality of, in particular contiguous, feature values can be drawn upon. Furthermore, a partial aspect of the feature value, for example a certain wavelength upon capturing of a spectral region, can be employed for generating or capturing the feature intensity.

In a further step, the location-based feature intensities are classified with the help of a threshold value. With the help of the threshold value, a location-based classification of the feature intensity can be effected for each location-based feature intensity, for example as locally authentic or locally false. Furthermore, location-based limits of a location distribution to be expected of the machine-readable feature substance are determined. These limits preferably represent the longitudinal extension and/or width extension, particularly preferably the areal extent, of the value document. Furthermore, errors in the structure can be established with the help of the limits, for example forgeries in some regions of a value document, in particular upon undershooting a minimum length.

In a further step, the location-based distribution of the classified feature intensities is assessed. In the process, at the least two classified feature intensities are assessed in relation to each other and/or to the certain location-based limits.

The feature intensities at the individual measuring locations having above-threshold intensity are preferably classified as locally authentic, or those having below-threshold intensity as locally false. These measuring locations are designated hereinafter also as classified pixels.

For assessing the location-based distribution of the classified feature intensities, it can be determined for example based on the number and spatial distribution of the below-threshold and/or above-threshold feature intensities. Alternatively to a, where applicable local, threshold value, a reference feature intensity can be drawn upon as a comparative value.

Value documents are understood here to be sheet-shaped objects having a front side and a back side that represent for example a monetary value or an authorization and hence should not be manufacturable arbitrarily by unauthorized persons. They hence have features that are not simple to manufacture, in particular to copy, whose presence is an indication of authenticity, i.e. manufacture by an authorized body. Important examples of such value documents are coupons, vouchers, checks and in particular bank notes.

A reliable assessment of the completeness or authenticity succeeds by the use of the method according to the invention in the two alternative variants of the measurement of the machine-readable feature with or without measurement of the remission values. In one embodiment, a specific location-dependent threshold value is associated with at the least one location or pixel. Preferably, a location-dependent threshold value is associated with a plurality of locations or pixels or a group thereof. With the help of location-dependent threshold values, a more detailed location-dependent classifying of the location-based feature intensities is possible. In particular, special location-dependent properties can be represented and checked by the location-dependent threshold values.

According to one embodiment of the invention, the local authenticity is established with the help of a feature intensity. Preferably several feature values, for example of a luminescence radiation are drawn upon for the appraisal of the local authenticity. These include a time behavior of the feature intensity such as a rise behavior, a decay behavior, a spectral distribution of the feature intensities and/or spatial information items such as e.g. a track information item or a transport position. In particular, a specific matching of the established feature values with the expected feature values of an authentic value document can be effected and be taken into consideration upon the establishment of the feature intensity. For example, the feature intensity can be established, e.g. as zero, in spite of considerable luminescence intensity being present, if the spectral distribution of the luminescence radiation does not match the expected spectrum.

With the present invention, a local authenticity of the value document is in this way determinable starting out from a local feature value. Moreover, an assessment of the total value document for completeness and/or authenticity is possible.

In one embodiment of the invention, remission values are captured in a location-resolved manner for several different locations of the value document. The measuring locations of the remission values preferably correspond substantially to the measuring locations of the feature intensities. The area of the measuring location of a remission value can be larger or smaller than the area of the measuring location of the corresponding feature intensity. Preferably the measuring locations have a same area. The measuring location of a remission value can be also executed in a shifted manner, preferably in overlap to the measuring location of a feature intensity. The location-resolved capturing of the remission values is preferably executed simultaneously to the location-resolved capturing of the feature intensity values.

The captured location-based remission values can, according to one embodiment, be parameters of a characteristic curve for location-dependent or location-based threshold values.

According to the invention, the track completeness is determined in one embodiment. In the process, respectively feature values, i.e. location-based feature intensities and, where applicable, location-based remission values, can be captured along a measuring track on the value document and be taken into consideration for determining the track completeness.

For example, the data of this measuring track are evaluated by the employment of the invention as a single track sensor. Then, however, substantially only a one-dimensional track completeness can be checked and assessed. For this purpose, first the individual feature intensities and, where applicable, remission values of the pixels are compared individually with a minimum value and are classified as authentic or false, or correspondingly, for example as below-threshold, above-threshold or median. The length of the value document can be determined from the distance of the two outermost measurement points having a signal intensity above a minimum threshold.

Furthermore, the measured length of the value document can be determined preferably in a transport direction by an edge detection from a feature intensity curve. In the feature intensity curve, feature intensities are captured in a location-resolved manner. I.e. the feature intensity curve comprises value points which result from the feature intensity and the appurtenant location. In the simplest case, the extreme locational positions are determined in which an averaged threshold (upper threshold−lower threshold)/2 of the feature intensities is reached. Preferably, quantile values are employed instead of upper threshold and lower threshold, e.g. 75% (=almost white) and e.g. 5% quantiles (=almost black) corresponding to the maximum feature intensity. From the difference of the two location-based feature intensities, the measured length of the value document results, wherein as a rule the size of the pixel or measuring location distance is taken into consideration, in particular included in the calculation.

In one embodiment, the precision of the length determination can be increased by interpolating the feature intensity curve between the measured points, preferably linearly (alternatively by spline), and with it determining the length at subpixel accuracy.

The established or determined length is thereupon compared with a known or pre-specified minimum length, which corresponds e.g. to the real length of the shortest denomination variant of a bank-note series.

If the minimum length is not reached, in any case a forgery portion is to be assumed. The completeness can be quantitatively determined simply from the ratio of the number of pixels with above-threshold feature intensity, or authentic pixel, to the number of pixels corresponding to the measured length (for an assumed constant transport speed or locational resolution).

The measurement of the feature sensor is preferably triggered by a light barrier (e.g. of the bank-note processing machine) such that the measurement points of different value documents can always be associated with different data sets. The evaluation for completeness from the length determination therefore relates to as a rule exactly one value document.

In principle, regions with distinctly reduced feature intensity can, however, also occur within an individual (authentic) value document, up to fully vanishing feature intensity, if for the excitation radiation and/or radiation emanating from the value document, opaque features such as e.g. metallized holograms, security strips, or similar cover the machine-readable feature substance. The—according to denomination—maximum possible width of the opaque covers as well as their position relative to the, in transport direction, leading and/or trailing edge are taken into consideration for the completeness assessment.

In one embodiment for computing or determining the track completeness, a sensor has several measuring tracks, such as e.g. 2, 4, 6, 8, 10, 20 or more measuring tracks, so that a two-dimensional distribution of the feature intensities is recorded. For the completeness assessment, first a threshold value classification of the individual location-based feature intensities is likewise performed. Thereupon, a convex envelope around the established above-threshold location-based feature intensities is computed. Furthermore, known or pre-specified location-based below-threshold feature intensities are compared, for example by a background system, with the established location-based above-threshold feature intensities encompassed by the convex envelope, for example a number. If, for example, the number of the established above-threshold feature intensities is smaller than the known number of above-threshold feature intensities, for example an unwanted hole in the value document can be assumed. This method therefore allows the recognition of holes or opaque spots within the value document which are not wanted and therefore point out a forgery.

In place of a convex envelope as to above-threshold location-based feature intensities, the evaluation can be effected on below-threshold location-based feature intensities. Furthermore, an evaluation with reference to, where applicable, captured and known or pre-specified remission values is possible.

In one execution, the convex envelope is computed separately for each line, i.e. in this case the interval between front and back end of line. For each interval, below-threshold location-based feature intensities are marked as false or correspondingly.

In one execution, a two-dimensional convex envelope is computed over the positions of all above-threshold pixels, e.g. with the Graham algorithm. All below-threshold pixels having positions within the convex envelope are marked, for example as false or correspondingly.

In one embodiment, below-threshold location-based feature intensities within the convex envelope can be rejected if, for example, their measuring locations lie within occurring patterns, such as e.g. a transparent window or a metallic LEAD strip.

Furthermore, preferably the two-dimensional distribution of the above-threshold pixels is analyzed and evaluated. In the process, in particular the occurrence of larger holes is checked. In particular location-based feature intensities classified as false or correspondingly are established and are identified, marked and counted in two-dimensional contiguous regions. If e.g. more than 2, 3, 5, . . . (resolution-dependent) contiguous location-based feature intensities are present classified as false or correspondingly, thus a potentially missing region is recognized. Thereupon, the position and geometrical extent of the regions classified as false or correspondingly is analyzed and matched with known, occurring patterns such as e.g. a transparent window or a metallic LEAD strip. In particular the form, maximum width and relative position to the edges or corners of the value document is checked as to plausibility and upon deviations is classified as "incomplete" or similar.

In one embodiment having highly different resolving power of the measurement in (x) track direction and y direction (track number) can be counted in a targeted manner as false or correspondingly classified neighboring pixels in line direction and multiple pixel in this direction can be assessed.

Thereupon, the individual tracks are assessed analogously to the above-described single-track sensor, which delivers several measurement values for the track completeness.

In one embodiment, the authenticity and/or completeness of the value document is recognized if at least a certain ratio between the number and a spatial distribution of the classified pixels, feature intensities and/or remission values is present.

In one embodiment, the measured length can be determined from the maximum value of the individual determined track lengths and upon deviations of the other track lengths, preferably taking into consideration a tolerance value, lack of completeness can be concluded.

Analogously to the track completeness, a column completeness can be established, in particular by considering several measuring tracks.

In one embodiment, the location-resolved capturing of the feature intensities can comprise the measurement of a spectral luminescence intensity of a luminescent substance. Correspondingly, the value document can be checked for presence or non-presence of a luminescent substance and be checked as to authenticity and completeness according to its local association or distribution. Furthermore, the location-resolved capturing can comprise a spectral measurement of a Raman band and/or a so-called surface-enhanced Raman spectroscopy (SERS). Moreover, the capturing can comprise a measurement of an absorption band with respect to a certain spectral region, for example infrared, and/or the measurement for magnetic properties.

The capturing of feature values can precede the capturing of feature intensities. Feature values can comprise measuring results, for example with regard to a spectrum. The feature values are in particular specifically processed to supply feature intensities. In the process, the feature values can be proved by a filter, for example for evaluating a spectral region, in particular a wavelength. Furthermore the feature values can be proved by an algorithm. The feature values can be sensor values from which feature intensities are finally determined. The feature values can comprise respectively a plurality of different feature intensities.

The capturing of feature intensities and/or, where applicable, remission values can be effected on a front side as well as on a back side of the value document. In particular, feature intensities and/or, where applicable, remission values can be captured on the same and/or opposing side, in particular with reference to the measuring location. Preferably, the feature intensities and/or, where applicable, remission values are captured at same, opposing locations of the front side and back side.

In one embodiment, location-dependent threshold values can be determined by a characteristic curve which depends on the feature intensities determined at the side opposing the respective location of the value document.

In one embodiment, transmission values are captured in a location-resolved manner, preferably by time-shifted illumination within the framework of remission measurements on front side and back side and/or by a time-shifted illumination within the framework of the measurement of feature values or the capture of feature intensities on the front side and back side of the value document.

In one embodiment, respectively a combined classification can be performed at several measuring locations taking into consideration the data tuples associated with the measuring locations. The data tuples comprise at least one feature intensity as well as at the least one of the following components: a further feature intensity, a remission value, and/or a transmission value.

Furthermore, the above-mentioned object is achieved by a sensor or a sensor unit and/or a bank-note processing machine which are configured for executing a method set forth here.

The sensor can be a part of the sensor unit and/or the bank-note processing machine.

Preferably, the local exciting of the value document, in particular of the feature substance, is effected with the aid of an excitation radiation. The feature substance preferably has a luminescent substance or a Raman-active substance or a substance detectable by surface-enhanced Raman spectroscopy (SERS). Furthermore, the feature substance can have magnetic properties. Additionally or alternatively to the enumeration, however, any feature substance having machine-testable properties is conceivable. In the present case, the feature substance can also be viewed as a marker.

In one embodiment, the excitation radiation can be spectrally narrow-band, broad-band, or a superimposition of different narrow-band and/or broad-band radiation components.

In one embodiment, the value document is illuminated with a check radiation for checking a presence of a document substrate at the respective measurement point, for measuring the size of the value document and/or for measuring a remission value.

For capturing feature intensities and/or remission values, according to one embodiment of the invention the excitation radiation and/or the check radiation is measured in a location-resolved manner.

The value documents to be checked for completeness within the framework of this invention are equipped with at least one machine-readable feature substance which was incorporated in or applied along at least one track in moving direction of the value document. The machine-readable feature substance comprises preferably at least one luminescence marker (luminescent substance), particularly preferably inorganic illuminants on the basis of host lattices doped with rare-earth or transition-metal ions.

In the process, the machine-readable feature substance is preferably distributed homogeneously over the area of the value document or is incorporated homogeneously into the volume of the value document (paper or polymer). Alternatively, it can be imprinted over the full area or in partial regions of the value document, however, at least along a track over the length, or, in case of a transverse transport, over the width of the document. In the case of a luminescing feature substance, this can emit either at shorter wavelength (anti-Stokes luminescence or upconverter) and/or at longer wavelength than the excitation wavelength (Stokes luminescence). Anti-Stokes emitters are not preferred because they typically have a distinctly lower lightness.

Preferably, it is a paper value document which has a Stokes luminescent substance incorporated in homogeneous distribution in the paper volume via the pulp upon the paper manufacture.

In a preferred variant, at least two independently measurable feature substances, which are spatially distributed either the same way or differently, are present in the value document. This can be, e.g. two independent, feature substances incorporated in the substrate of the value document (polymer or paper). Alternatively, a feature substance can be present in the substrate and a second feature substance be imprinted.

The general construction of the sensor is described as follows. For carrying out the method according to the invention, a suitable sensor is required for the machine-readable feature. In the case of a luminescence feature or a SERS feature, this is typically designed for the spectrally resolved proof of the feature substance. The feature sensor is preferably incorporated in a machine for the automated checking or sorting of value documents, in particular a bank-note processing machine. This transports the value documents to be checked linearly through the capture region of the sensor device in a pre-specified transport direction.

The feature sensor can comprise a luminescence sensor. The luminescence sensor is preferably configured as a detection device for the spectrally resolved detection of the luminescence radiation in at the least one pre-specified spectral detection region and delivers detection signals which express at the least one, in particular spectral, property of the detected luminescence radiation. The spectral resolution can be achieved either by dispersive elements, such as diffraction grating in reflection or transmission, or by suitable filters in front of the respective detector elements. The spectral resolution of the detector has at least two wavelength channels, preferably >4, particularly preferably >8 different wavelength channels.

For exciting the luminescence radiation emanating from the value document, the sensor illuminates this in a capture region with an excitation radiation. This is coordinated with the luminescent substance employed for marking the value document and is located in the optical range, i.e. in the UV, VIS or IR spectral region. The excitation radiation can be spectrally narrow-band, broad-band or a superimposition of different narrow-band and/or broad-band radiation components.

The luminescence sensor preferably is additionally equipped with a remission sensor. Here, this illuminates the value document with a check radiation in addition to the excitation radiation. This serves the check for presence of the document substrate at the presently illuminated location or the size measurement of the value document and/or the measurement of the remission. In one variant, the check radiation preferably has a spectral distribution which overlaps with the spectral detection range of the detection device at the least partly or even completely. In this case, the remission of the value document can be determined directly without a separate detector being required for this.

In an alternative variant there is present besides the illumination device for the check radiation also a separate check radiation detector together with, where applicable, required illumination, collimation and/or imaging optics, with which, besides the luminescence radiation, also the remission is measured in a location-resolved manner and is associated via the geometrical imaging properties of the two detection channels respectively with the appurtenant measuring locations of the luminescence radiation.

Preferably the illumination areas of the excitation radiation and the check radiation mutually overlap spatially very much or are largely identical in the capture region of the sensor, so that the spatial association of the measurement values can be directly effected.

Furthermore, the sensor has a control and evaluation device which controls the emission of excitation radiation or check radiation and receives the signals of the detection device(s), and processes and evaluates these with regard to authenticity or completeness.

The check radiation as well as the excitation radiation are generated with suitable light sources such as e.g. incandescent lamps, flash lamps, LEDs or laser diodes, in particular edge emitters or VCSELs. Where applicable, filters or illuminant converters are additionally required to generate the desired spectra. The remission is typically determined in the visible spectral region either in a wide or alternatively also narrowly limited wavelength region. Alternatively, the remission can also be determined in a non-visible spectral region such as e.g. in the UV or in the NIR.

In a first step, the luminescence signal obtained during each measurement cycle can be evaluated locally for each individual measurement point. This can comprise the assessment of a spectral distribution, e.g. after an offset or background correction, wherein signal contributions possibly incorporated by scattered light or by the amplifier or evaluation electronics are eliminated. The correction parameters necessary for this can either be fixedly preset or be dynamically determined with the help of suitable dark measurements. These can then be carried out, e.g. if currently no value document is located in the capture region of the sensor and/or a measurement point (or several) on the value document itself is "sacrificed" and instead a dark measurement is carried out without excitation illumination and without check illumination.

Optionally, the measured spectra can be normalized with preset or separately measured illumination intensities or remission values etc. measured at specific calibration substrates.

Furthermore, the local authenticity of the value document is checked on the basis of the measured luminescence signal. This can be effected on the basis of the spectral distribution or additionally also evaluate the rise behavior and/or decay behavior. In the process, at least an intensity value is computed which represents a measure for the local luminescence intensity and is stored together with the measuring location, i.e. e.g. the x y coordinate formed from track and transport position.

Likewise, the remission value is determined in the case of narrow-band check illumination, or the remission values of several spectral channels in the case of spectrally resolved remission measurement. The established remission value is stored together with the measuring location, i.e. the transport position.

Generally the further evaluation proceeds in two steps: First, the feature measurement values are classified into measuring locations having above-threshold feature intensity (authentic or analogously) and measuring locations having below-threshold feature intensity (false or analogously). Thereupon the completeness is established with the help of the number and distribution of the location-resolved feature intensities classified as false.

Case 1 describes an evaluation without denomination information and without remission measurement. In this most difficult case, the sensor measures merely the machine-readable feature without possessing further information about the present value document or about its real or apparent size. Therefore merely the measuring data distribution of the machine-readable feature is available for the completeness assessment. Nevertheless, a sound statement can be made as to the completeness even on the basis of these restricted information items.

In reality, forgeries or incomplete value documents, from which narrow vertical structures or strips were cut, occur relatively frequently. To be able to recognize this efficiently, an assessment with regard to a column completeness is helpful. Here, the number of the below-threshold pixels is established column by column and compared with a threshold value. If this threshold is now exceeded (by e.g. 2 or 3) in a column, the value document is rejected as incomplete. These forgery classes having vertically extensive tampering are thereby recognized particularly effectively.

Preferably, a different assessment takes place between the boundary tracks and mid tracks. This allows recognizing missing measuring regions, which occur upon a tilting of the value document during transport, and reducing the frequency of value documents falsely classified as incomplete. In the process, in one embodiment for example the track completeness can generally be ignored upon the assessment. Alternatively, the boundary track can be assessed in the shortened form within the extent recognized by the remission measurement.

In a preferred case several feature substances measurable independently from each other are present in the value document. Advantageously, separate feature values of these are captured and these are evaluated or assessed. If a feature value is present at a measuring location, it directly follows that at this location—even under inclusion of the spatial distribution of the second feature substance—the second feature substance also has to be measurable.

In this case, generally a union of the convex envelopes of the distributions of the two feature-substance measurement values can be drawn upon as a measure for the geometrical extent of the value document.

With it, the case suspect of forgery, when a further outwardly located track delivers an apparently longer banknote length than a further inwardly track, can be correctly identified. This means, in particular, that if an outwardly located boundary track n having a valid first measurement value is present, then also the track n, but at least the further inwardly located neighboring track (n−1) is also assessed completely for the second feature relating to the track completeness. The assessment is effected, of course, respectively taking into consideration the expected target distribution of the respective feature substance. This procedure is applied analogously for the uppermost as well as the lowermost tracks.

In a preferred case the completeness check is effected through an machine-dependent evaluation during which the actually present geometry ratios with respect to the value-document transport are taken into consideration. Depending on the machine model, the alignment of the transported value documents can be effected either along the lower edge or e.g. mid-centered. This has the consequence that upon processing different denominations having different sizes (in particular widths), different tracks may expect feature signals depending on the machine. Because these transport properties always remain constant, they are taken into consideration advantageously for the assessment of the completeness and parametrized upon the installation of the sensor. In the process, it is defined in particular which tracks always are to be completely present (mid track(s) versus lowermost track or second-lowermost track for considering a skew).

For the completeness assessment of the value document, preferably the track completeness as well as the area completeness is evaluated and finally combined into an index for the completeness. In the process, a recognized lacking track completeness can lead to the entire value document being recognized as incomplete, even if the area completeness lies maybe still within an accepted tolerance threshold.

A particularly reliable assessment of the completeness is effected upon checking at the pixel level (pixel completeness), at the level of the measuring tracks (track completeness) as well as by evaluating the two-dimensional distribution of the obtained measurement values (area completeness or two-dimensional completeness).

BRIEF DESCRIPTION OF THE DRAWINGS

Further features and advantages of the invention will result from the present description of embodiment examples of the invention as well as further alternative embodiments in connection with the following drawings, which show:

FIG. 10*a*: A schematic representation of location-based distribution of classified feature intensities;

FIG. 10*b*: A schematic representation of location-based distribution of classified feature intensities of an incomplete bank note;

FIG. 13: A schematic representation of a combined classification of feature values.

DETAILED DESCRIPTION OF VARIOUS EMBODIMENTS

Figure 1:
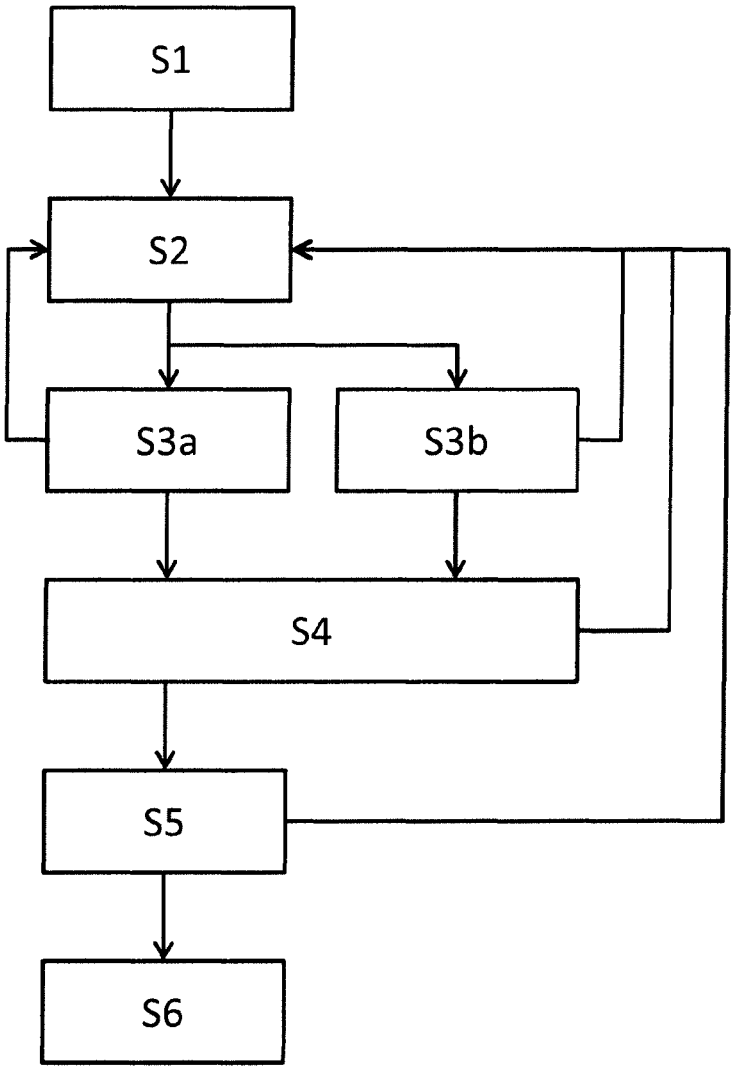
FIG. 1: A schematic representation of an embodiment of a method according to the invention.

In FIG. 1 a process flow for checking of a value document according to the invention is represented schematically.

In a first Step S1 a value document is supplied. The value document comprises at the least one machine-readable feature substance. The feature substance is arranged at two different locations at the least, preferably over a substantial region of the value document. Preferably the machine-readable feature substance extends partially in the total areal extent of the value document.

In a Step S2, the value document is excited at least locally preferably with electromagnetic radiation. The exciting can be effected by means of irradiating the entire value document. Preferably a regional, particularly preferably a point-wise, irradiating of the value document takes place. By means of a sensor unit, a feature value is captured location-resolved, in particular a feature intensity with respect to the machine-readable feature substance is captured (S3*a*) at several different locations of the value document. The capturing relates to, as a rule, the areal section of the value document which was excited by means of electromagnetic radiation, wherein preferably the excited section has an area equal to or greater than the captured region or point.

Preferably, substantially simultaneously to Step 3*a*, a remission value is captured in a location-resolved manner with respect to the feature values captured in Step 3*a* (S3*b*), wherein also several remission values can be captured which, for example, relate to different wavelengths.

In a Step S4, the feature values and the preferably captured remission value are evaluated in a location-resolved manner according to Steps S2, S3*a* and, where applicable, S3*b*. In the process, the feature values are compared with expected reference signals and respectively one feature intensity each is established for the feature values captured in a location-resolved manner. Preferably a normalization of the location-based feature intensities takes place.

Starting out from the evaluation from Step S4, a classification of the location-based feature intensities takes place in Step S5. The classification is effected based on a lower threshold value of the feature intensities (see FIG. 2*a*) or a combined employment of a lower and an upper threshold value of the feature intensities (see FIG. 2*b*) or an employment of different threshold values of the feature intensities, in particular in dependence on one or different remission values (FIG. 3).

The evaluation of a feature value and the classification of a feature intensity can be carried out temporally independent from the capturing of further feature values. Therefore, for a feature intensity preferably Step S4 can be effected immediately after Step S3*a* and/or Step S4 be effected for one or several feature intensities after the capturing of the several feature intensities according to S3*a*. Analogously, for a feature intensity preferably Step S5 can be effected immediately after Step S4 and/or Step S5 be effected for one or several feature intensities after the evaluating of the several feature intensities according to S4.

In Step S6, a location-based distribution of the feature intensities is determined starting out from the evaluation from Step S4 or alternatively starting out from the classification of the feature intensities from Step S5. Expected location-based limits of the distribution of the feature substance are derived from the location-based distribution. These location-based limits are established either from the distribution of the classified location-based feature intensities, for example by computation of the convex envelope of the above-threshold feature intensities, or are established by including further measurement values, in particular the remission values.

Thereupon, the location-based distribution of the classified feature intensities obtained in Step S5 is assessed in Step S7. The assessment is effected in particular with regard to the relative position of the pixels classified as above- or below-threshold to each other as well as with regard to the relative position of the pixels classified as below-threshold relative to the limits determined in S6 of the location distribution to be expected of the machine-readable feature substance.

On the basis of the assessment from Step S7, a completeness measure is finally established for the entire value document which can be drawn upon for the authenticity assessment or e.g. for sorting decisions in a bank-note processing machine.

In the diagrams cited now, the colors are employed, yellow with reference sign "ge", green with reference sign "g", black with reference sign "s", red with reference sign "r" and blue with reference sign "b". All specified color particulars are to be understood only by way of example and serve only for illustrative purposes. Of course, values or other designations can be employed instead of the color particulars.

Figure 2A:
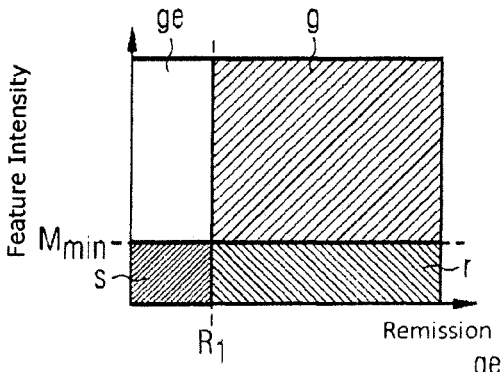
FIG. 2*a*: A first diagram according to one embodiment for classifying at pixel level.
Figure 2B:
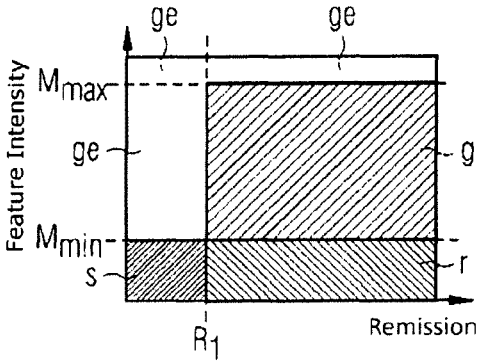
FIG. 2*b*: A further diagram according to one embodiment for classifying at pixel level.
Figure 3:
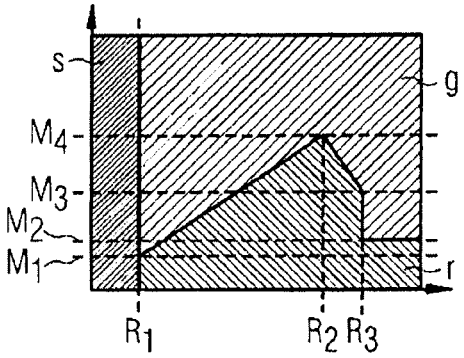
FIG. 3: A schematic representation of a characteristic curve for threshold values for the classification at pixel level.
Figure 4:
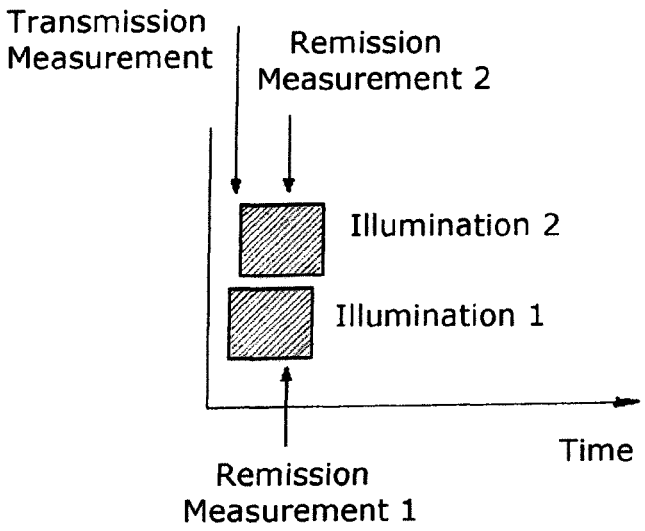
FIG. 4: A schematic representation of the time course of the illumination for remission.

In FIGS. 2*a* and 2*b*, an intensity field is represented respectively for a scanned pixel, wherein the threshold values for feature signals or remission signals employed for classifying at pixel level are entered according to an aspect of the present invention by way of example.

The classification of the pixels as authentic/false is effected by way of example with reference to FIG. 1 as follows. For assessing a value document as to authenticity and/or completeness, a classification is performed on pixel basis.

All measurement points or pixels which have remission values above a certain threshold $R_1$ in the remission channel also have to deliver a sufficient feature intensity in the feature signal to be recognized as an authentic portion of the value document. In this way the feature intensity has to be higher than a lower threshold of the feature intensity $M_{min}$. This classifying of all pixel while employing fixed threshold values can be clearly represented with the help of the 4-field board according to FIG. 2*a*.

FIG. 2*b* shows threshold values for feature intensity values or remission values for classifying at pixel level in a modified 4-quadrant diagram using a lower threshold $M_{min}$, $R_1$ and an upper threshold $M_{max}$. In the process, all pixels which are sufficiently light (i.e. remission value R>remission threshold value $R_1$) are assessed as "green" and deliver an sufficiently intense feature signal (feature intensity M>minimal feature intensity $M_{min}$ (lower threshold value of the feature intensity)). Pixels too dark ($R<R_1$), as they can occur e.g. due to holes in the value document, are classified as "black", whereas present regions of the value document ($R>R_1$), i.e. a sufficiently high remission value is captured, and without sufficient feature signal is classified as suspect of forgery, in particular as a snippet forgery, as "red". If regions are present having insufficient remission but sufficient feature intensity, these are classified "yellow" as a feature excess. This can occur e.g. with heavy soiling (with special spectral behavior of the illuminated areas) or in window regions with an invisible feature.

Furthermore, according to FIG. 2*b* an upper threshold for the expected feature intensity $M_{max}$ is employed. Here, all regions with an excess of feature signal can then be classified "yellow". The combined evaluation of remission and feature intensity at pixel level allows in any case a simple consideration of otherwise problematic situations, such as a high running (i.e. y offset) or skew running of a value document in the processing machine as a result of a transport malfunction.

In a further-reaching embodiment, the remission signal is employed at pixel level to normalize the feature signal (only in the linear region) for the purpose of a correction of soiling or overprinting. In doing so, boundary effects are likewise taken into consideration if the value-document edge overlaps only partly with the measurement pixels and hence reduced feature and remission intensities are recognized.

Alternatively, the threshold required for the authenticity detection for the feature intensity can advantageously be dynamically adapted pixel-wise with the help of the measured remission signal. Here, a characteristic curve or a characteristic diagram for the authenticity detection is defined as is shown in FIG. 3.

FIG. 3 shows a characteristic curve for the threshold values for the classification at pixel level. The presence of a document for remission values R above a remission threshold $R_1$ is recognized. This threshold can be fixed for all tracks uniformly, or preferably, parametrized individually for each track with the help of reference measurement values for white or black samples.

If a very dark region is registered on the document, a reduced threshold value is also applied for the feature intensity M ($M_1>M$). If correspondingly lighter regions ($R_1<R<R_2$) are present, thus preferably the required feature intensity threshold is increased correspondingly between $M_1$ and $M_4$. At especially highly reflective places ($R>R_2$) it can be assumed that here no normal paper-of-value substrate is present but rather a metallic reflector such as a hologram, security strip or the like. Because these are typically opaque for optical radiation, the threshold value for the feature signal is reduced accordingly down to $M_3$, because the covered areas can in some cases deliver only a highly reduced signal contribution. If the spatial resolution of the feature sensor is not distinctly higher than the dimensions of the opaque structures, a masking will not be effected digitally but rather usually occur partially. This is taken into account by a gradual reduction of the feature threshold between $M_4$ and $M_3$ in the range $R_2<R<R_3$. For the purposes of a strong recognition of forgeries, a minimum of feature signal $M_2$ can also be required with very high remission values $R>R_3$. For a particularly strict assessment, $M_2=M_3$ can also be chosen. In these classifying variants, a hologram strip is marked in "red". Alternatively, $M_2$ can also be parametrized to very low values, which results in a classifying of reflective hologram strips as "green".

At the boundary of the value document, "red" pixels can randomly occur due to an only partial overlap between value document and measurement pixel, which have to be treated or tolerated separately in the further assessment. Alternatively, the origination of these red boundary pixel can be prevented by a suitable parametrization of the threshold characteristic curve for $R_1$ or $M_1$. In so doing, $M_1$ is set lower (relative to the maximum intensity) than $R_1$, so that by the purely geometrical loss of intensity, which relates equally to remission as well as feature intensity, the situation cannot occur that indeed still $R>R_1$, but already $M<M_1$.

Upon the presence of several independently measurable feature substances, the feature measurement values can, of course, analogously as described in the case without remission measurement, be assessed individually as well as in a combined manner.

Pixel Completeness:

The first check for completeness is now performed on pixel basis: Within the recognized region of the value document, the number of measurement points or pixels classified as "red" may not exceed a certain threshold. In the strictest interpretation having the threshold 0 this means that not one single measuring location having insufficient feature intensity is allowed to be present, in order that the value document is recognized as complete. In other variants, individual "red" pixels can be tolerated.

Here, the ratio of the number of all green pixel relative to the number of all pixel within the extent of the value document can again be formed and checked against a minimum threshold. This corresponds to an area proportion or the area-based degree of completeness.

Track Completeness:

The track lengths determined from the remission measurements are employed respectively as a scale for assessing the track completeness. For computing the index for the track completeness, the number of the pixels is classified as "green" in this track is divided by the number of all pixel within this track length. Alternatively, one obtains a slightly stricter check criterion if for computing the index for the track completeness the number of the pixels classified as "green" in this track is divided by the number of pixels corresponding to the maximum length of the value document.

A further check criterion is the number of neighboring "red" pixels within the length of the value document and within a track. If this exceeds the defined threshold, the track is counted as incomplete. For the parametrization of this threshold, the maximum width of "red" regions occurring in authentic value documents, such as e.g. the maximum extent of hologram patches or similar, is expediently taken into consideration.

Analogously to the above-described procedure upon the determination of the track completeness without remission measurement, measuring tracks in boundary location can be assessed differently than mid tracks here too, although the corresponding position uncertainties are much lower here because of the remission measurement.

Two-Dimensional Completeness:

In the preferred case that the sensor has several measuring tracks, here too, as already described above, the two-dimensional distribution of the feature intensity or the two-dimensional distribution of the classified pixels is evaluated.

By means of the convex envelope around the pixels having above-threshold remission, holes or opaque spots can be localized within the value document. In the process, the occurrence of larger holes is checked in a targeted manner. For this purpose, "red" below-threshold neighboring pixels within the extent determined by the convex envelope of the value document are searched for and two-dimensionally contiguous regions are counted and identified/marked. If e.g. more than 2, 3, 5, . . . (resolution-dependent) contiguous red pixels are present, thus a potentially missing region is recognized. Thereupon the position and geometrical extent of the "red" regions are analyzed and matched to patterns occurring in the known manner such as e.g. a transparent window or a metallic hologram strip. In particular the form, maximum width and relative position to the edges or corners of the value document is checked as to plausibility and upon deviations is classified as "incomplete".

Here too, an assessment can be performed for the efficient recognition of forgeries or incomplete value documents having vertical tampering structures with regard to the column completeness. Here, the number of the red pixels is established column by column and compared with a threshold value. If this threshold is now exceeded (by e.g. 2 or 3) in a column, the value document is rejected as incomplete.

For those forgery classes in which in the boundary-region sections of the authentic value document were replaced by e.g. a photocopy, an real qualitative advantage arises from the combined evaluation of the remission and the feature intensity: These forgeries can now be reliably recognized by the exact determination of the actual extent of the value document. In the process, in particular a targeted check can be performed for the presence of boundary columns classified as "red" (which were established by counting the red pixels in column direction). In the process, preferably the outermost two columns are assessed in order not to overrate or falsely assess the red boundary pixels randomly occurring from edge effects.

In one embodiment having highly different resolving power of the measurement in (x) track direction and y direction (track number), this is taken into consideration by the fact that "red" neighboring pixels are counted in line direction in a targeted manner and multiple pixel in this direction are assessed as particularly severely. In particular, the maximally occurring width of a hologram strip (or similar security features such as metal color) can be taken into consideration by the fact that value documents with a greater number of red pixels in the higher resolved measurement direction than a defined threshold value are directly classified as incomplete.

Both-Sided Measurement

In particularly preferred variants, the authenticity sensor comprises two partial sensors which allow a both-sided measurement of the feature intensity on each value document. In the process, preferably a remission channel is also available on at least one side—or particularly preferably on both sides—with which (track) length as well as exact position and alignment of the value document are determined.

In one embodiment, the two partial sensors are controlled centrally to synchronize the time courses of the excitation or measured value acquisition for both partial sensors. Alternatively, two individual independent sensors are used for front side or back side which are synchronized in a master/slave configuration by one of the two sensors ("master"). For example, this master sensor sets the operating mode and pre-specifies time delays to be adhered to for the measurement pulses and/or measured value acquisition after a trigger signal.

Furthermore, preferably different sensor architectures can be used for the master or slave sensor. Thus, for example, one of the sensors can be equipped with a more elaborate measuring technology than the other sensor and check the feature values with a higher precision or a higher spectral resolution.

The two partial measurements of front side and back side are thereupon evaluated combined. In the process, the measuring data are associated with the respective measuring locations on the value document, the location-based data tuples of (Remission, Feature1, Feature2) or (Remission1, Remission2, Feature1, Feature2) are formed and evaluated.

Preferably, the position or clocking of the two measurements (front, back) are coordinated with each other such that the value document is measured at the same pixel positions on front side and back side. Particularly preferably, the measurement takes place respectively (almost) simultaneously, i.e. a measurement point is captured at a place of the value document from the front and from the back side at almost the same time.

Beside the simpler and more unambiguous assessment of the thus obtained measurement values, this offers the advantage that a usually unpreventable crosstalk between front-side measurement and back-side measurement does not lead to artifacts and spurious signals, but rather reinforces the feature signal to be measured.

In the process, the illumination of the first partial sensor can be utilized advantageously also for a transmission measurement using the detector part of the second partial sensor if the two illumination light pulses have a small time offset, so that the transmission signal can be recorded temporally separate from the remission signal 2. This time sequence of the light pulses or detections is represented schematically in FIG. 3. In this case, Transmission, Remission1, Remission2 as well as Feature1, Feature2 are available for each measuring location as a base of data for the completeness evaluation. This makes the complete completeness assessment possible even for existing opaque (metallic) or transparent (window) security features which can otherwise hinder the completeness check of certain parts of the value document.

The illumination for the remission measurement (alternatively: feature measurement) of the front side and the back side are effected slightly time-shifted, so that detector 2 can determine the transmitted portion of the illumination 1 independently and undisturbed from the illumination 2 as it is shown in FIG. 3.

In the simplest case, upon the evaluation the sum (or the mean value or the maximum) from Feature1 and Feature2 is formed at each measuring location and is thereupon classified and assessed according to the above-described procedures.

A more exact assessment is reached if individual thresholds are applied for Feature1 and Feature2. These can depend on remission as well as on the respectively other feature value. A corresponding characteristic diagram then takes the place of the just described characteristic curve for the pixel-wise red/green assessment. This can be adapted/parametrized exactly to the typical optical effects occurring in authentic value documents.

Figure 5B:
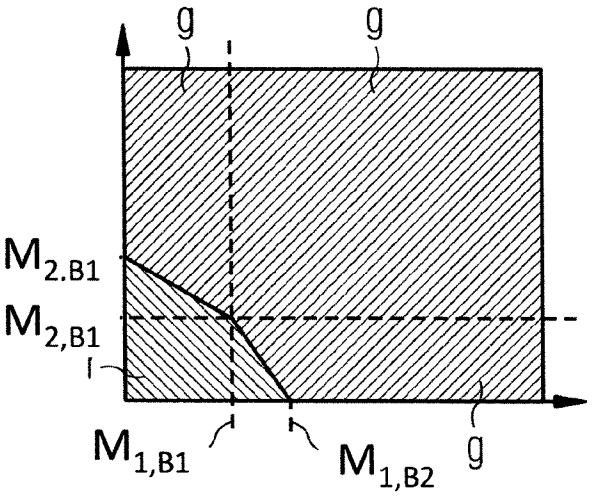
FIG. 5*b*: A schematic representation of a further characteristic curve for classification at pixel level with both-sided feature measurement.
Figure 5A:
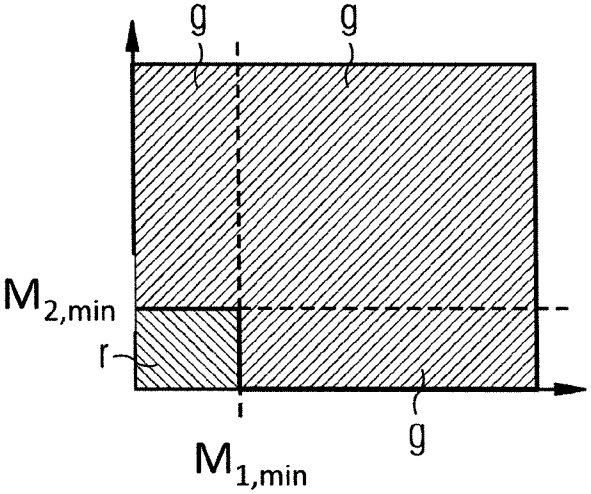
FIG. 5*a*: A schematic representation for classification at pixel level for both-sided feature measurement.

FIGS. 5*a* and 5*b* show a characteristic diagram for the threshold values for classification at pixel level upon both-sided feature measurement. In FIG. 5*a*, a classification is effected on account of static threshold values of feature values ($M_{1,min}$, $M_{2,min}$). Using the characteristic diagram in FIG. 5*b*, a classification is effected taking into consideration interference effects such as e.g. reflection at metallic surface structures applied to one side.

If, for example, a (reflective hence opaque) metallic strip is applied to a bank note on a side B1, it is to be expected that indeed on one side the FeatureValue1 is very low, the FeatureValue2 to be expected, however, is increased due to the occurring reflections compared with the immediate environment (or compared with the mean value over the entire bank note). This can be represented by the corresponding parameterization of the threshold characteristic diagram. Conversely, upon an overprinting on page B1 with black, spectrally broadband-absorbing (carbon black) color, the remission value and FeatureValue1 are low, whereas FeatureValue2 is at normal level.

The parameterization of the classifier is advantageously depending on the location, i.e. e.g. relative to the leading edge, relative to the corners, or concrete position within the convex envelope, etc. This allows a correct treatment of absorbable and reflective disturbance in dependence on (position- and denomination-dependent) the effects possibly occurring in these regions. In both cases the corresponding region can in any case be reliably assessed as authentic due to the both-sided feature measurement in spite of the insufficient feature intensity on one side.

This allows the gapless proof of the completeness independent of the bank note design, even in difficult situations with (one-sidedly occurring) covers/shadowing by opaque elements such as aluminum-coated hologram strips. With it, regions of the value document can also be reliably checked for completeness/authenticity which cannot be assessed by only one-sided measurement.

In a preferred variant, the complete present data set of (Transmission, Remission1, Remission2, Feature Intensity1, Feature Intensity2) is classified and assessed in a combined manner. Besides regions having opaque, absorbent or reflective concealments, in particular also holes or window regions, can be reliably identified in the process by the transmission signal, and their position and extent can be checked in comparison to the values permissible for authentic value documents. Further embodiment examples are described hereinafter.

Example 1: Here, a spectrally resolving single-track luminescence sensor having remission measurement is employed for the completeness check. The sensor is operated on a bank-note processing machine at a transport speed of 11 m/s and is employed for the authenticity check as well as completeness check of bank notes having a luminescence sensor-coordinated luminescence marker incorporated in the paper. The bank notes have a reflective hologram strip on the front side in the right region.

Figure 6:
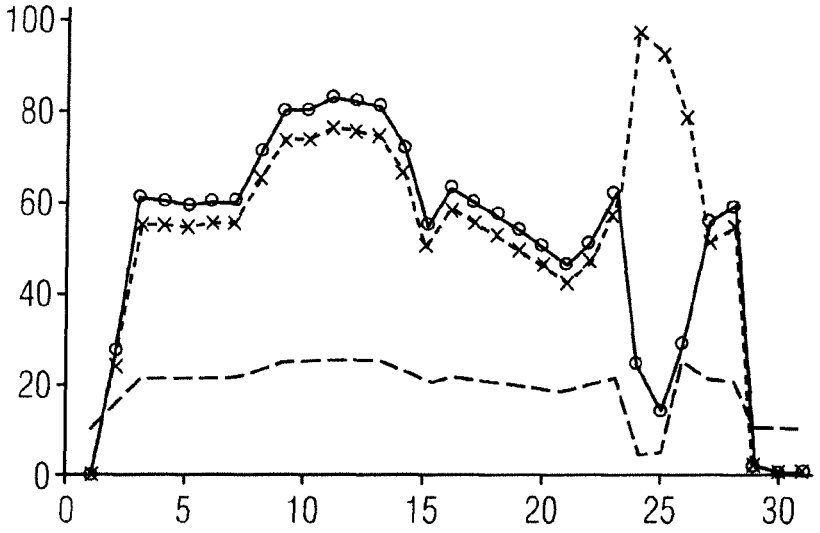
FIG. 6: A curvature of feature intensity, remission value as well as a dynamically established threshold value for the classification at pixel level.

FIG. 6 shows a feature curve (O), a remission curve (x) and the dynamically computed feature threshold (dashed) of an authentic and complete bank note. Remission intensity as well as feature intensity are significantly modulated. The completeness can nevertheless be established correctly by applying a remission-dependent threshold upon the classification of the feature intensity.

Example 2: Here, a spectrally resolving 11-track luminescence sensor having remission measurement is employed for the completeness check. The sensor is operated on a bank-note processing machine at a transport speed of 11 m/s and is employed for the authenticity check as well as completeness check of bank notes having a luminescence marker incorporated in the paper. The bank notes have a reflective hologram strip on the front side in the right region as well as a transparent window in the left region.

Figure 7:
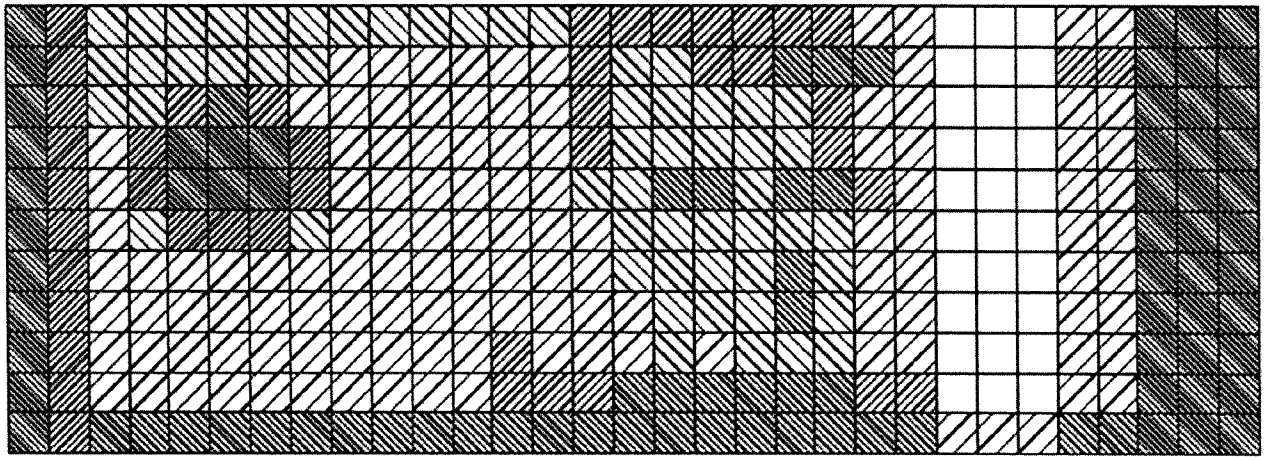
FIG. 7: A schematic representation of remission values of a bank note to be checked.

FIG. 7 shows a representation of the measured remission values of the bank note. High remission occurs in particular in the region of the reflective hologram strip, while very low remission is present in the transparent window.

Figure 8:
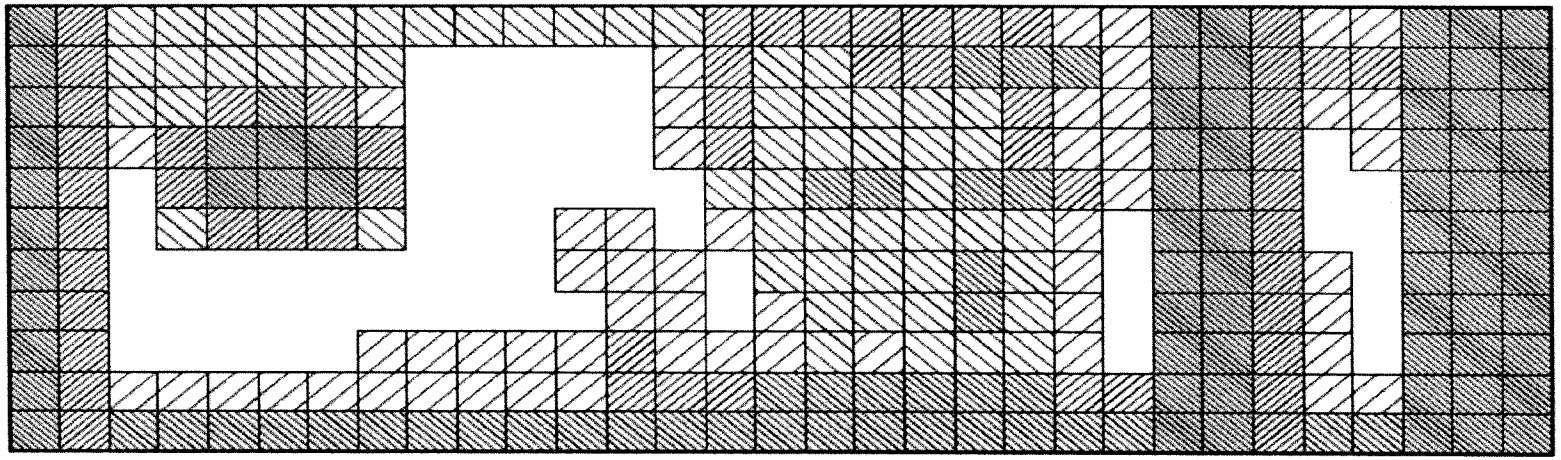
FIG. 8: A schematic representation of feature intensities of a bank note to be checked.

FIG. 8 shows a representation of the feature intensity of the bank note. White corresponds to high intensity, while black corresponds to low values. In the region of the window (on the left) as well as the hologram strip (on the right) only very low feature intensity is detectable.

Example 3: For comparison, correspondingly prepared snippet forgeries having approx. 10% of forgery portion were measured.

Figure 9:
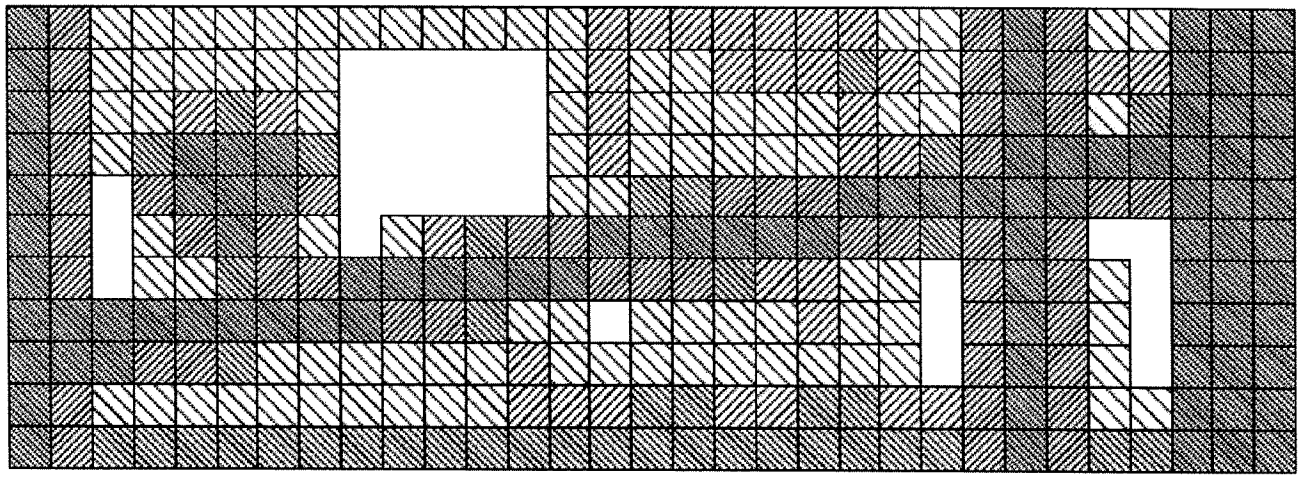
FIG. 9: A schematic representation of feature intensities of an incomplete bank note to be checked.

FIG. 9 shows a representation of the feature intensity of an incomplete bank note with a diagonally inserted strip of a copy without feature.

FIG. 10*a* shows a pixel-wise classification of the bank note (FIG. 7-8) with dynamic threshold. The low feature intensity in the region of the hologram strip could be taken into consideration by the dynamic threshold, while the missing feature intensity is marked red in the window region in the absence of remission signal. (0=black, 1=red, 2=yellow, 3=green)

FIG. 10*b* shows a pixel-wise classification of the incomplete bank note (FIG. 9) with dynamic threshold. The low feature intensity in the region of the hologram strip could be corrected by the dynamic threshold, while the missing feature intensity is marked red in the window region in the absence of remission signal. The missing feature region is correctly recognized and likewise marked red. (0=black, 1=red, 2=yellow, 3=green)

Example 4: The bank note of FIG. 7-8 was again surveyed with a sensor construction having both-sided measurement. Feature1 (front), Feature2 (back), Remission) (front), Remission2 (back) were measured as well as the transmission.

Figure 11:
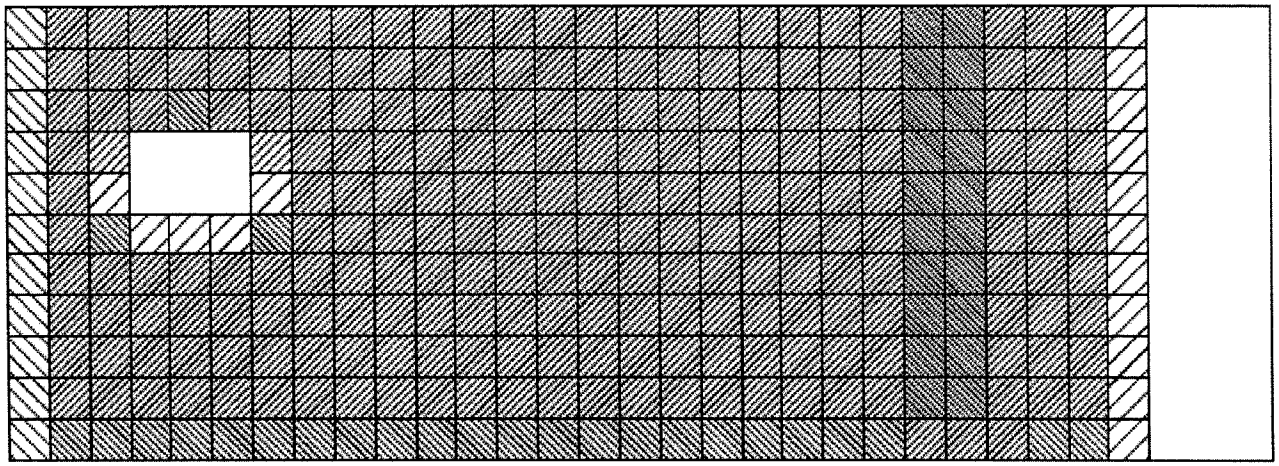
FIG. 11: A representation of transmission values of a bank note.

FIG. 11 shows transmission data of the bank note

Figure 12:
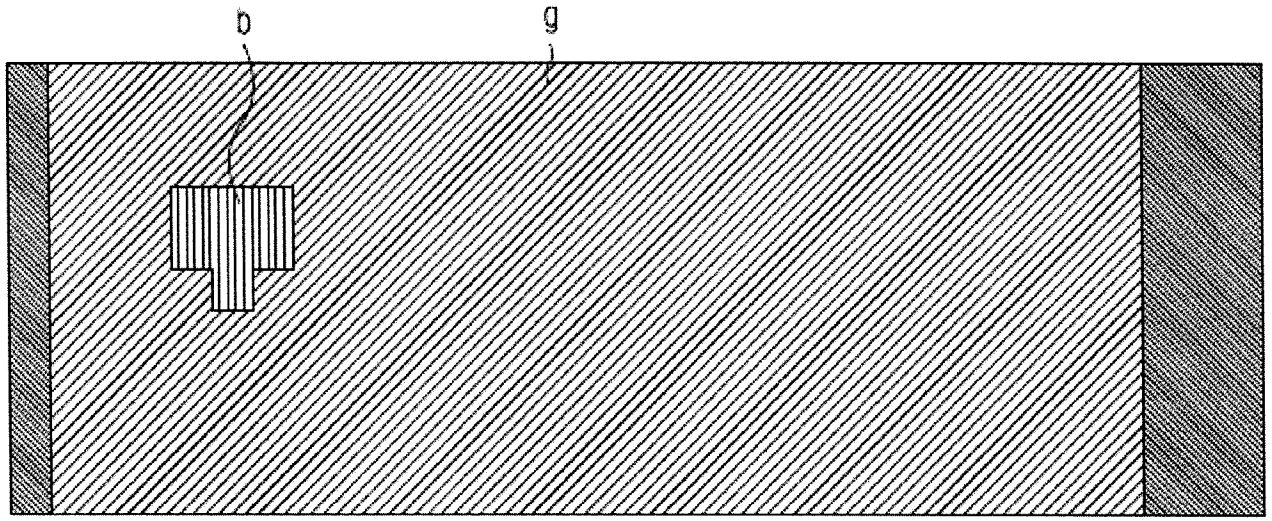
FIG. 12: A further schematic representation of a pixel-wise classification.

For classifying the measurement pixels, the front side and back side were classified separately with dynamic feature threshold were thereupon separately combined according to the following association of the class allocations established respectively on front side (Classification1) and back side (Classification2), into an overall classification for each pixel, as shown in FIG. 12.

The window region was thereupon recognized with the help of the high transmission>85 and was correspondingly classified as "window" (4).

FIG. 12 shows a pixel-wise classification of the measuring data of the complete test bank note established on both sides, with dynamic threshold and transmission measurement. (0=black, 1=red, 2=yellow, 3=green, 4=light blue) Here, in spite of the regarding measurement technique difficult architecture of the bank note having metallically reflective and transparent window regions, all regions are reliably checked for local authenticity and the completeness is correctly assessed.

In FIG. 13, a combination of feature values classified on both sides is schematically represented, according to which likewise an assessment of the value document or the bank note on authenticity and/or completeness is effected.

The invention claimed is:

1. A method for checking the completeness and/or authenticity of value documents, wherein at least one value document comprises at least one machine-readable feature substance at at least two locations of the value document, the method comprising:

applying an excitation energy to at least a local portion of the at least one value document;

capturing a location-resolved feature intensity with respect to the at least one machine-readable feature substance at several different locations of the at least one value document;

performing location-based classification of the captured location resolved feature intensities for each of the several different locations of the at least one value document using a threshold value;

determining location-based limits of a location distribution to be expected of the at least one machine-readable feature substance relative to the at least one value document, said location-based limits being established from a location-based distribution of the classified feature intensities or from including further measurement values; and assessing a location-based distribution of the classified feature intensities with respect to a relative position of pixels classified as below-threshold relative to the location-based limits of the location distribution to be expected of the machine-readable feature substance;

wherein the location-based limits represent a longitudinal extension and/or a width extension of the at least one value document.

2. The method according to claim 1, wherein the classification of the location-based feature intensities is effected with the help of location-dependent threshold values.

3. The method according to claim 1, further comprising capturing location-resolved remission values at several different locations of the at least one value document.

4. The method according to claim 3, wherein the threshold value is configured as a location-dependent threshold value which is determined from a characteristic curve dependent on the remission value determined at the respective location.

5. The method according to claim 3, wherein the measuring locations of the remission values overlap with the measuring locations of the feature intensities.

6. The method according to claim 3, the method further comprising checking a two-dimensional distribution of the classified feature intensities relative to a convex envelope of measuring locations with above-threshold feature intensity or, provided that remission values were captured, relative to a two-dimensional distribution of the measurement values of the remission measurement.

7. The method according to claim 1, the method further comprising computing a track completeness by a comparison of a number of measuring locations having above-threshold feature intensity with a number of captured measuring locations within a convex envelope of the measuring locations having above-threshold feature intensity or, where applicable, within a convex envelope of the measuring locations having above-threshold remission value.

8. The method according to claim 1, wherein the feature intensities are captured along at least one measuring track on the value document.

9. The method according to claim 1, wherein the location-resolved capturing of the feature intensities with respect to the machine-readable feature substance comprises the measurement of a spectral luminescence intensity of a luminescent substance and/or the spectral measurement of a Raman band of a Raman-active substance and/or a substance detectable by surface-enhanced Raman spectroscopy and/or the spectral measurement of an absorption band of a substance absorbing in the infrared spectral region and/or the measurement of the magnetic properties of a ferromagnetic substance.

10. The method according to claim 1, wherein a local authenticity of the at least one value document is checked using at least one feature value.

11. The method according to claim 1, wherein a number and a spatial distribution by measuring locations classified as below-threshold is compared with reference values.

12. The method according to claim 1, wherein the value document is moved during the measurement at a speed of 1-13 m/s.

13. The method according to claim 1, wherein the location-resolved capturing of the feature intensities of the machine-readable feature substance and/or, where applicable, the remission values on front side and back side of the value document, is effected in particular at same, opposing locations of the front side and back side.

14. The method according to claim 13, wherein the location-dependent threshold values are determined by a characteristic curve which is dependent on the feature intensity determined at the side opposing at the respective location of the value document.

15. The method according to claim 1, wherein location-resolved transmission values of the value document are captured.

16. The method according to claim 15, wherein the transmission measurement is effected through a time-shifted illumination within the framework of remission measurements on front side and back side and/or through a time-shifted illumination within the framework of the measurement of feature values on front side and back side.

17. The method according to claim 1, wherein at several measuring locations respectively a combined classification is performed with consideration of data tuple associated with the measuring locations, wherein the data tuple comprise at least one feature intensity as well as at the least one of the following components: a further feature intensity, a remission value, and/or a transmission value.

18. A system configured for checking the completeness and/or authenticity of value documents, wherein at least one value document comprises at least one machine-readable feature substance at at least two locations of the value document, the system comprising:

a light source configured to apply an excitation energy to at least a local portion of the at least one value document;

a detector device configured to capture a location-resolved feature intensity with respect to the at least one machine-readable feature substance at several different locations of the at least one value document; and a processing machine configured to:

perform location-based classification of the captured location resolved feature intensities for each of the several different locations of the at least one value document using a threshold value;

determine location-based limits of a location distribution to be expected of the at least one machine-readable feature substance relative to the at least one value document, said location-based limits being established from a location-based distribution of the classified feature intensities or from including further measurement values; and assess a location-based distribution of the classified feature intensities with respect to a relative position of pixels classified as below-threshold relative to the location-based limits of the location distribution to be expected of the machine-readable feature substance;

wherein the location-based limits represent a longitudinal extension and/or a width extension of the at least one value document.

* * * * *